US005988451A

United States Patent [19]

Hanna

[11] Patent Number: 5,988,451

[45] Date of Patent: Nov. 23, 1999

[54] WASHING SYSTEM

[75] Inventor: Emmanuel A. Hanna, Lakeview Terrace, Calif.

[73] Assignee: Bobrick Washroom Equipment, Inc., North Hollywood, Calif.

[21] Appl. No.: 08/701,788

[22] Filed: Aug. 26, 1996

[51] Int. Cl.[6] ..... B65D 88/54

[52] U.S. Cl. ..... 222/255; 222/105; 222/321.1

[58] Field of Search ..... 222/95, 105, 252, 222/255, 256, 330, 331, 321.1, 321.6, 321.7, 181.1, 181.2, 181.3, 263, 265, 266, 278; 4/639, 640, 654

[56] References Cited

U.S. PATENT DOCUMENTS

| | | | |
|---|---|---|---|
| D. 349,649 | 8/1994 | Hanna . | |
| 1,479,978 | 1/1924 | Bobrick et al. | 222/255 X |
| 1,586,397 | 5/1926 | Bobrick | 222/255 X |
| 2,238,449 | 4/1941 | Peters | 222/321.7 X |
| 2,515,328 | 7/1950 | Bobrick | 222/321.7 X |
| 3,319,835 | 5/1967 | Ensign et al. | 222/321.7 X |
| 4,120,619 | 10/1978 | Blackband | 222/321.6 X |
| 4,484,697 | 11/1984 | Fry, Jr. | 222/263 X |
| 4,515,294 | 5/1985 | Udall | 222/105 |
| 4,830,232 | 5/1989 | Greenberg et al. . | |
| 4,946,072 | 8/1990 | Albert et al. | 222/105 |
| 4,949,877 | 8/1990 | Hanna et al. . | |
| 4,964,544 | 10/1990 | Hanna et al. . | |
| 5,114,048 | 5/1992 | Minke | 222/331 X |
| 5,299,713 | 4/1994 | Saitoh | 222/255 X |
| 5,366,117 | 11/1994 | Mesenbring et al. . | |
| 5,476,197 | 12/1995 | Lawrence et al. . | |

OTHER PUBLICATIONS

Bobrick Catalog, Toilet and Bath Accessories, Jan. 1993, title page and p. 15.

*Primary Examiner*—Kevin P. Shaver
*Attorney, Agent, or Firm*—Pretty Schroeder & Poplawski

[57] ABSTRACT

A washing system for dispensing a liquid cleanser includes a dispenser having a positive displacement pump and a collapsible bag containing the liquid cleanser. The dispenser includes an inlet and an outlet to the positive displacement pump. The collapsible container includes an outlet. A container support means supports the collapsible container. A flexible supply line connects the collapsible container to the pump. The flexible supply line also has a first end connected to the outlet of the collapsible container and a second end connected to the inlet to the pump. A one way valve in the flexible supply line blocks fluid flow to the collapsible container while permitting fluid flow from the collapsible container to the dispenser.

20 Claims, 6 Drawing Sheets

WASHING SYSTEM

BACKGROUND OF THE INVENTION

This invention relates to washing systems for dispensing liquid cleansers, typically liquid or cream soaps. A typical washing system includes a container for the soap and a manually operated valve which may be an off-on valve or a pump valve. Ordinarily the container is mounted directly on the valve structure. A variety of such dispensers are in common use today.

In another type of washing system, a plurality of the dispensers are served from a single container. In one such system, sometimes referred to as a gravity soap system, a liquid reservoir is mounted on the wall above a plurality of basins, with a dispenser positioned at each basin and fed by a line from the reservoir. The head pressure of the liquid in the container above the dispensers causes fluid to flow by gravity into each of the dispensers to fill the valve cavity. Liquid is dispensed by actuating the open-shut valve to empty the valve cavity into the operator's hand. When the valve is closed, the cavity is refilled by gravity flow from the reservoir. While this system works adequately when the reservoir is positioned directly above the dispensers, it is not satisfactory when the reservoir is positioned at a distance from the dispenser or below the dispenser or at the same level as the dispenser, as liquid will not flow from the reservoir to the dispenser. Also, of course, it requires that the reservoir be significantly above the dispensers in order to produce the necessary head pressure.

In another configuration, sometimes referred to as an under-the-counter system, the reservoir is positioned directly under the counter and connected to each of a plurality of pump type dispensers mounted above the counter. With this type of construction, the reservoir is filled by removing one of the dispensers and pouring the liquid through the dispenser housing into the reservoir below the counter. After the refill operation, each of the pump dispensers must be primed by repeatedly actuating the pump mechanism. Typically about 75 to 110 strokes are required per dispensers to adequately prime the dispenser to start pumping. Also, the requirement of directly mounting the dispensers on the reservoir limits the capacity of the reservoir.

The two major concerns of any washing system today are the unit costs and the maintenance time (cost). Thusfar most installations have solved only one of the two issues. Some manufacturers reduce the maintenance cost by providing soap cartridges to reduce the bulk soap refilling time. Others provide bulk soap in low cost plastic soap dispensers. These have the disadvantages of higher maintenance cost and low or no vandal resistance.

The disadvantages of existing multiple valve and single reservoir systems include the following:

The valves are high cost, designed to withstand a high hydraulic head. The piping system is made of costly metallic pipes either inside the wall, requiring early plumbing, or exposed non-esthetically pleasing plumbing. The soap used has to be a water thin vegetable soap, to run in the pipes and meet the valve design criteria. Such soap, once popular, is now outdated and currently replaced with lotion type soap. This system was frequently malfunctioning, raising the maintenance cost.

There are major obstacles in improving the existing systems including:

1. Lotions in use today have too much friction with the tube length, thus not having sufficient pressure to be able to dispense at the valve outlet end.

2. The less expensive on/off gravity valves needed to be replaced by pumps to suck and push the lotions.
3. Such displacement pumps will empty the supply line, which will cause a problem in re-priming. Some installations may not re-prime at all, due to the long distance between the reservoir and the pump.

Accordingly, it is an object of the present invention to provide a new and improved washing system which will overcome the various problems and disadvantages of the earlier systems. In particular, it is an object to provide a new and improved washing system in which the initial cost of the various components will be reduced and in which the maintenance costs will be reduced, typically those related to the refill of the soap reservoir.

Other objects, advantages, features and results will more fully appear in the course of the following description.

SUMMARY OF THE INVENTION

The washing system of the present invention is designed for use with a sealed, large capacity cleanser reservoir in the form of a flexible or collapsible container which can be located at any height and in any area. The reservoir provides the cleanser to a plurality of individual dispensers, which may be attached directly to a wall or other support, with the dispenser pump itself within a housing for improved vandal resistance. Inexpensive flexible tubing serves to connect the cleanser container to the individual dispensers which can utilize multi-viscosity, low cost, bulk liquid soap from containers which can provide a month's supply. Actuation of the pump at the dispenser deposits the liquid directly into the user's hand. The amount of cleanser in the reservoir can be periodically checked and the reservoir replaced when the content falls to a predetermined level, or the reservoir can be replaced periodically on a scheduled maintenance event. Alternatively, one can wait until the reservoir is empty and then install a new reservoir without requiring re-priming.

The invention includes a washing system for dispensing a liquid cleanser from a collapsible container, with a plurality of dispensers, each dispenser having a positive displacement pump, mounting means for mounting the pump on a dispenser support, and connection means for connecting the pump to a flexible supply line, a container support for supporting a collapsible container of liquid cleanser, and a flexible supply line for connecting the collapsible container to each of the pumps, with a one-way valve in the line for blocking fluid flow to the collapsible container while permitting fluid flow from the collapsible container to the dispensers.

One embodiment of the washing system includes a cabinet with the container support positioned in the cabinet, with an access door for removing a used collapsible container and placing a new container in the container support, and a lock for securing the access door on the cabinet. In an alternative embodiment the container may be placed in a remote room.

In the preferred embodiment, the dispensers are mounted on a wall and the supply line is behind the wall. The dispensers may be mounted on a wall above a counter, with the container support means below the counter, and with the supply line behind the wall between the dispensers and the container support means. Alternatively the dispensers may be mounted on a wall in a first room, with the container support means in a second room, and with the supply line behind the wall between the dispensers and a cabinet support means in the second room. In another alternative embodiment, the dispenser may be mounted on a counter, with the container under the counter.

Each of the dispensers preferably includes a tubular casing with an inlet tube as the connection means for slidingly receiving an end of the flexible supply line and with the positive displacement pump slidably inserted into the casing, with the positive displacement pump having a cylinder with a piston cavity and a piston sliding in the cavity, means defining an inlet opening in the cylinder for fluid flow from the flexible supply line through the inlet tube into the piston cavity, a spring in the piston cavity for urging the piston outward, a one-way valve positioned between the inlet opening of the cylinder and spring, another one-way valve positioned between the spring and piston, with the piston having an outlet flow passage defining a flow path from the flexible supply line through the casing inlet tube, cylinder and piston cavity to the exterior of the dispenser.

Each of the dispenser pumps may further include a first retainer means for fixing the cylinder in the casing, first sliding seal means between the cylinder and casing for blocking fluid flow from the casing around the cylinder, second sliding seal means between the piston and the interior of the cylinder for blocking fluid flow from the cylinder around the piston, and second retainer means for retaining the piston in the cylinder while permitting reciprocation of the new piston in the cylinder during fluid dispensing.

DESCRIPTION OF THE PREFERRED EMBODIMENTS

Figure 1:
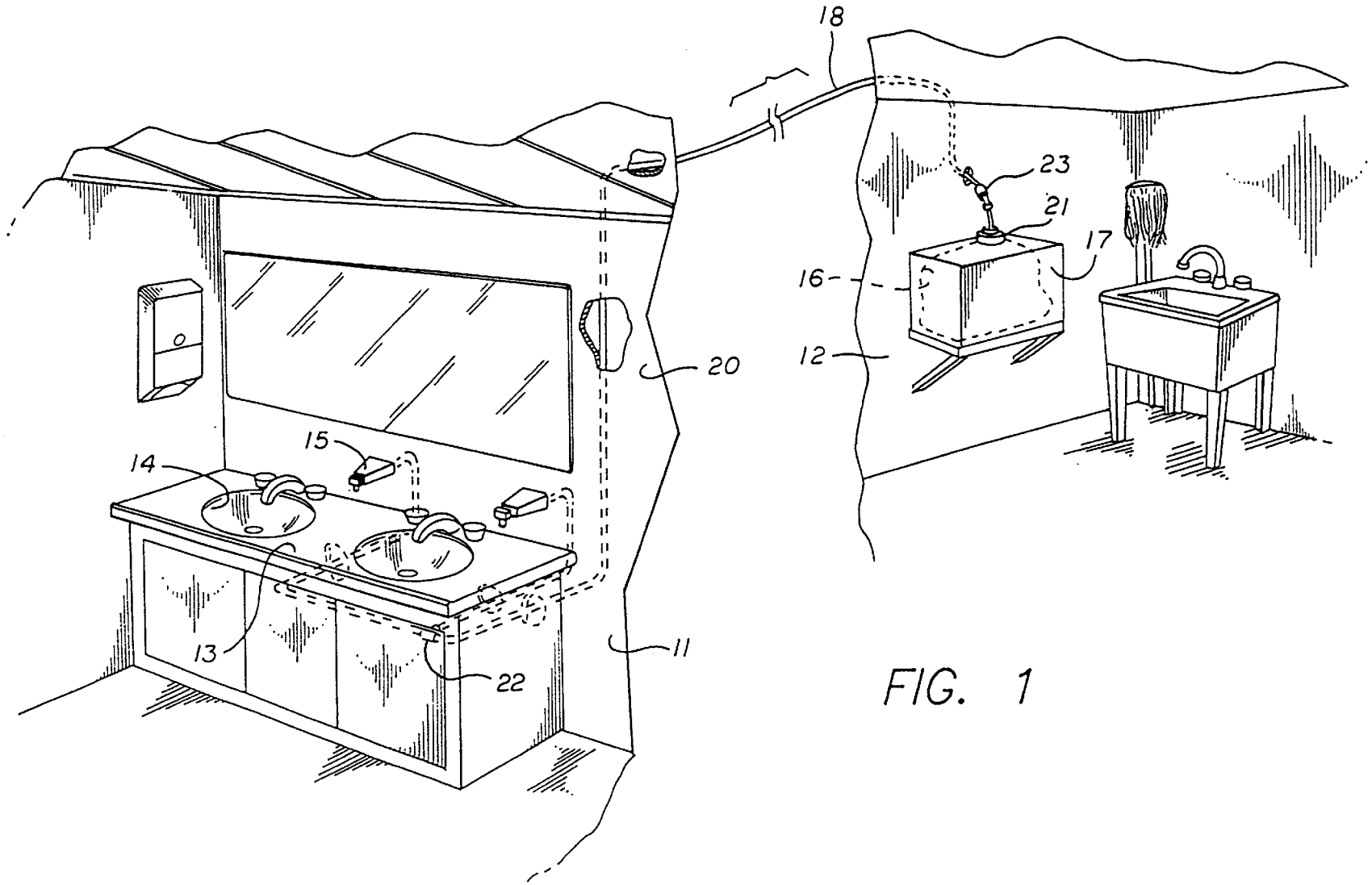
FIG. 1 is a perspective view illustrating the washing system of the invention with the liquid cleanser container mounted in a room separate from the wash basins and cleanser dispensers.

One embodiment of the washing system of the invention is illustrated in FIG. 1 installed in a washing room 11 and a service room 12. The washing room includes a conventional counter 13 with basins 14 and dispensers 15. A collapsible soap container 16 is positioned in a support box 17 in the service room 12, and is connected to the dispensers 15 via a flexible line 18, typically plastic tubing. The line 18 has an airtight cap or other connection 21 for connection to the container 16, and feeds liquid to each of the dispensers 15 through one or more tee fittings 22.

In the embodiment illustrated, the dispensers are mounted on the wall 20 of the washing room 11 in position above and adjacent basins 14. The line is positioned behind the wall 20 and is connected to the dispenser 15, as is shown in greater detail in FIG. 3. The line runs up the wall and above the hung ceiling of the washing room and onward to the service room 12 for connection to the liquid container. While two dispensers are illustrated, the washing system can be used with one dispenser and with more than two if desired.

Figure 2:
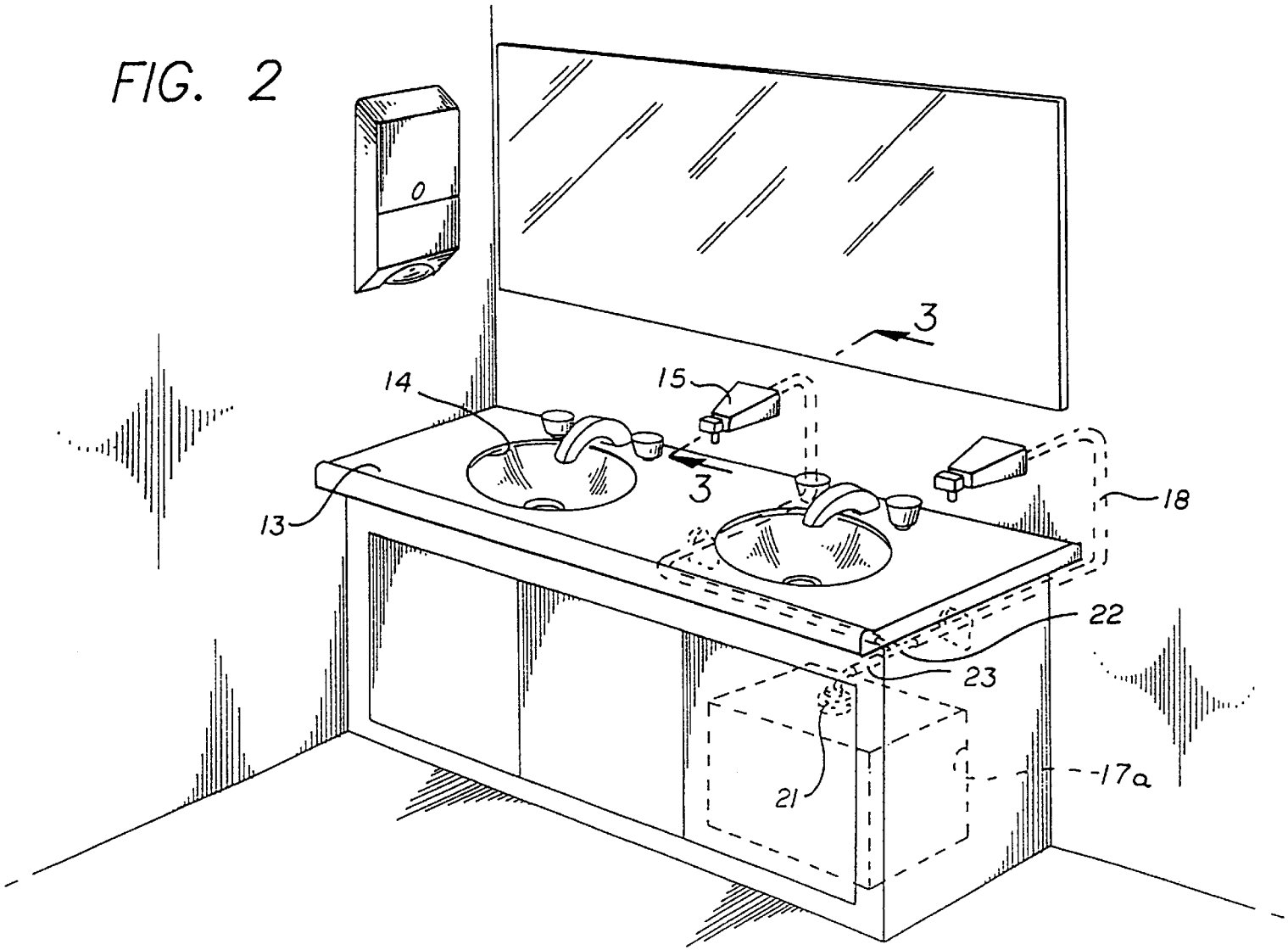
FIG. 2 is a view similar to that of FIG. 1 with the liquid cleanser container mounted underneath the counter.

An alternative configuration of the washing system in shown in FIG. 2, with the support box 17*a* for the container positioned below the counter 13. In each embodiment, the support box 17 may rest on a shelf, or in a cabinet, with or without a locked door, or on another article, or otherwise as desired.

Figure 4:
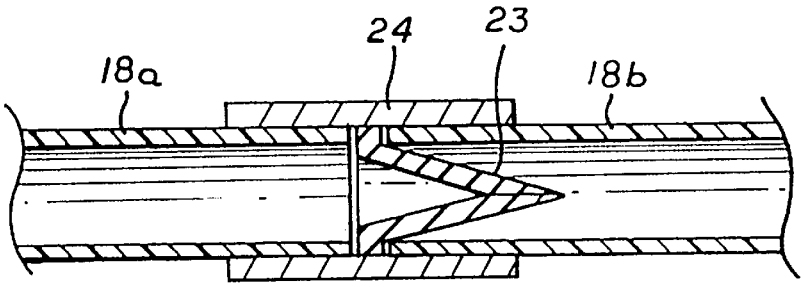
FIG. 4 is an enlarged sectional view of one configuration for installing the one-way valve in the supply line.
Figure 6:
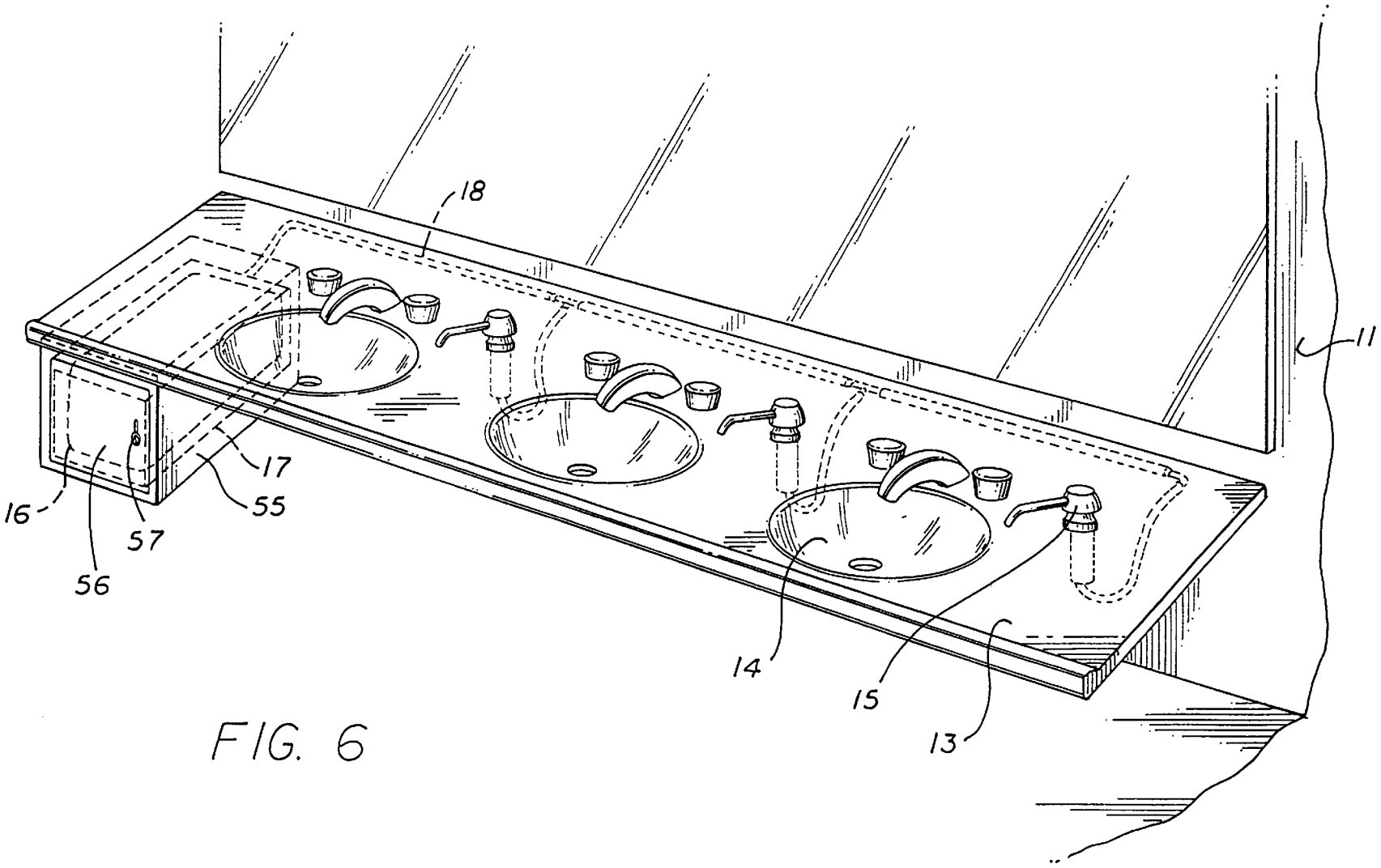
FIG. 6 is a view similar to those of FIGS. 1 and 2 with the dispensers mounted on the counter adjacent the basin, with the cleanser container mounted underneath the counter.

In each embodiment, a one-way valve 23 is positioned in the line 18 at a location between the fluid container 16 and the dispensers 15. The purpose of the one-way valve is to block fluid flow through the line from the dispensers to the collapsible container, while permitting fluid flow from the collapsible container to the dispensers. One specific installation for the one-way valve 23 is illustrated in FIG. 4. The line is formed in two sections 18*a*, 18*b* with the one-way valve 23 positioned between the two sections. In this installation the one-way valve is a flapper or duck type valve which permits fluid flow to the right as viewed in FIG. 4 while blocking fluid flow to the left. A sleeve 24 is positioned around the ends with the valve therebetween and may be clamped or cemented or otherwise held in place as desired.

Figure 5:
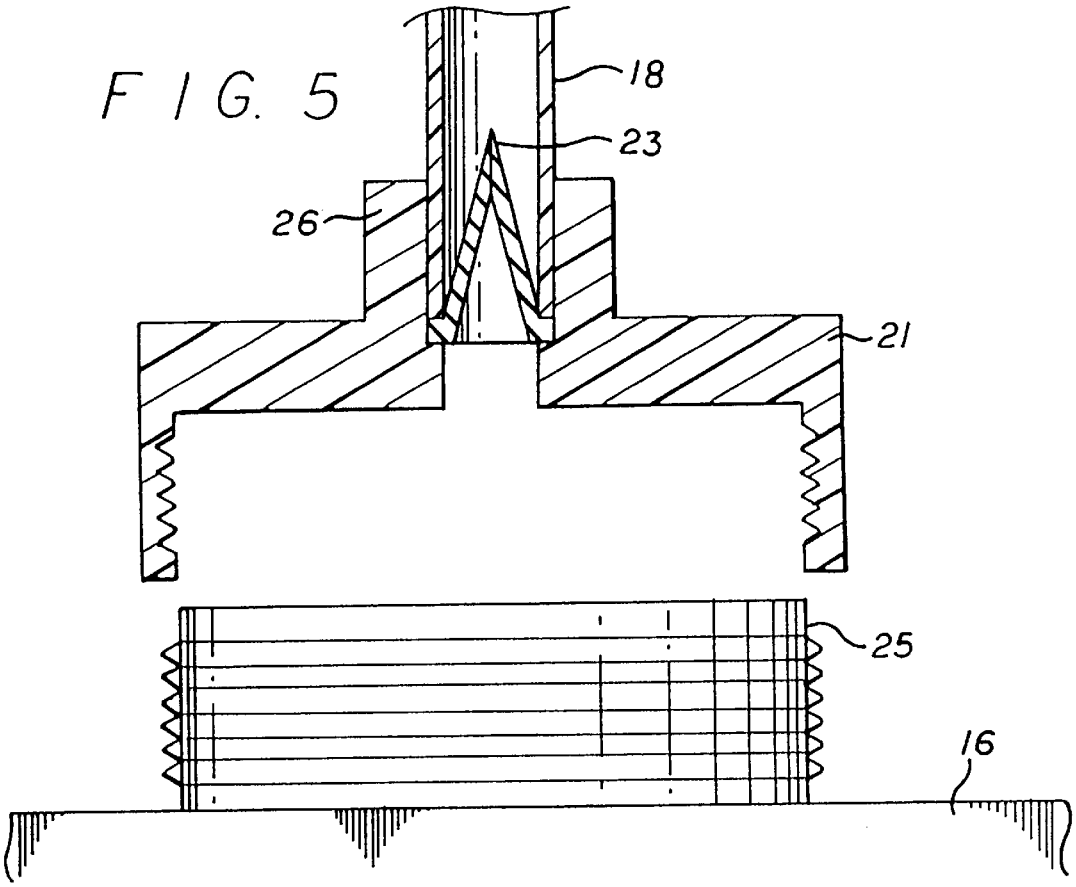
FIG. 5 is a view similar to that of FIG. 4 showing an alternate configuration for installing the one-way valve.

An alternative construction for positioning the one-way valve is illustrated in FIG. 5. The container 16 has a top or outlet 25 and the cap 21 fits over the top 25 as by screwing or by snapping or otherwise as desired. The one-way valve 23 is positioned in a section 26 of the cap, with the upstream end of the line 18 pushed into the section 26. The line may be clamped or cemented or otherwise held in place as desired. Since the supply line is a low pressure system, high pressure seals are not indicated.

Each dispenser includes a positive displacement pump which may be manually operable or electrically powered, as desired. The presently preferred embodiment of the dispenser is illustrated in detail in FIG. 3.; however, other configurations for the dispenser and positive displacement pump may be used. The dispenser includes a tubular casing 29 with an inlet tube 30 for connection to the line 18. The casing is mounted on the wall 23 with the tube 30 positioned in an opening 31 in the wall. The end of the line 18 may be fastened on the inlet tube 30 by a fastener 32. The casing 29 may be mounted on the wall 23 by toggle bolts or screws or other fasteners 33 positioned in aligned openings 34 in the casing 35 in the wall. The openings 34 are parallel with each other and perpendicular to the wall.

The positive displacement pump includes a cylinder 38 with a piston 39 sliding in a piston cavity 40 of the cylinder. A spring 41 is positioned in the cylinder cavity between a washer 42 and a one-way valve 43 at one end and another washer 44 and one-way valve 45 at the other end. The one-way valve may be conventional in design, such as a duckbill valve or a capsule valve with head holding capacity. A seal ring 46 is positioned on the cylinder for sealing engagement with the interior wall of the casing 29. Another seal ring 47 is provided in the piston for sealing engagement with the interior wall of the cylinder. A fastener such as a screw 48, provides for connecting the pump to the casing. A pin 49 is fixed in the cylinder 38 and rides in a slot 50 in the piston, permitting sliding of the piston in the cylinder while limiting the piston travel and preventing piston rotation, thereby keeping the soap outlet downwards.

Figure 3:
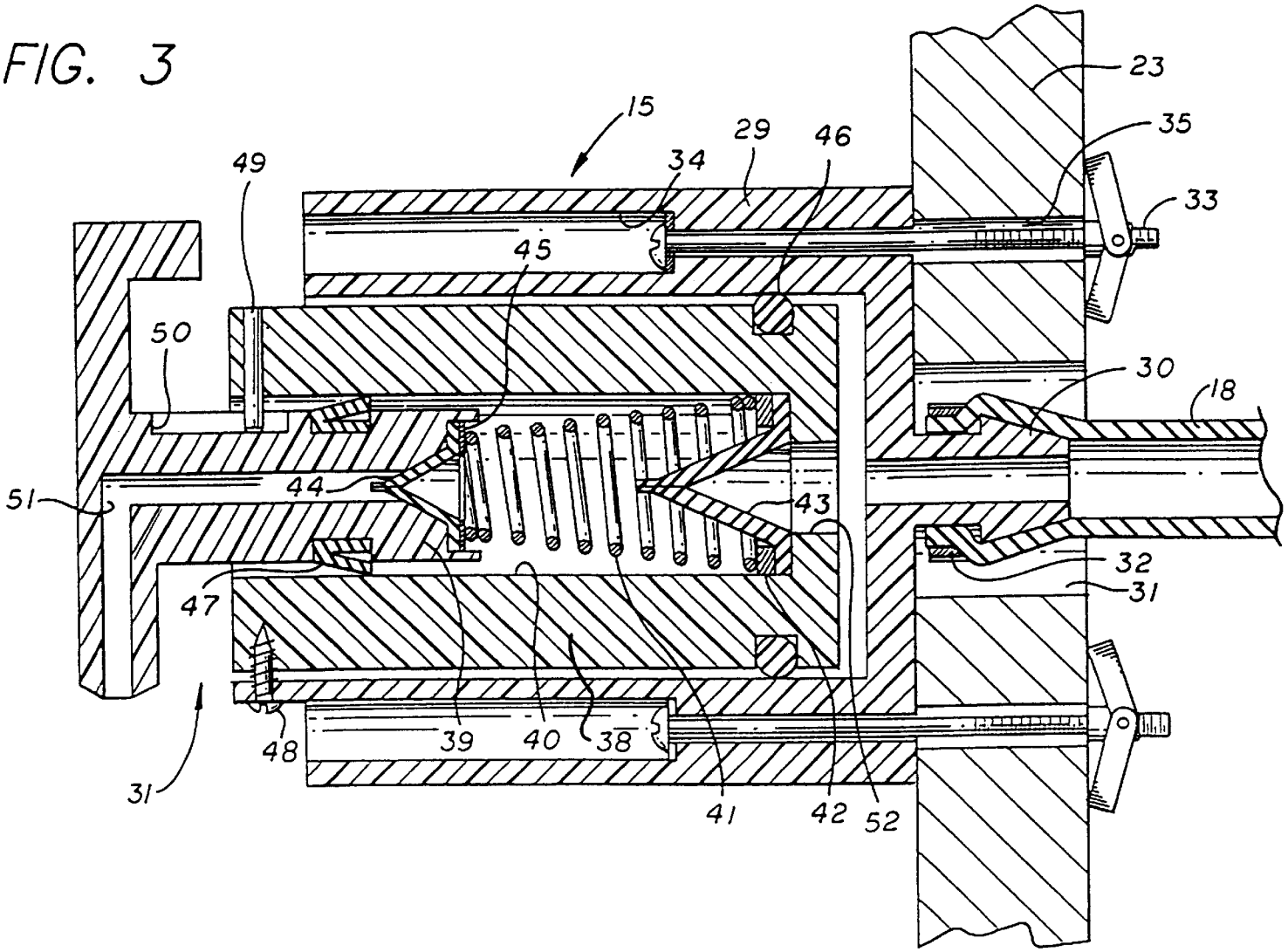
FIG. 3 is an enlarged sectional view of a dispenser, taken along the line 3—3 of FIG. 2.

In operation, moving the piston inward or to the right as viewed in FIG. 3, forces fluid from the interior of the cylinder out through the valve 44 and the passage 51 of the piston into the user's hand. When the inward pressure on the piston is released, the spring moves the piston outward, to the left as viewed in FIG. 1, which motion sucks fluid from the line 18 through the inlet tube 30 and opening 52 in the piston through the valve 43 into the interior of the pump, regardless of the position of the container with respect to the dispenser.

Since the dispenser does not operate with gravity flow, a construction for preventing leakage at high pressure heads is not required. The dispenser as disclosed has a low cost simple construction. The cylinder and piston may be plastic molded parts and the entire pump requires only two one-way valves, the spring, the retaining screw and pin, and the sliding seals. The casing itself should be a high strength casting to reduce damage due to vandalism, while this construction makes the pump easily replaced.

The casting typically may be chrome plated die cast zinc for both durability and strength. Alternatively, plated strong plastic material may be used for the casing. The positive displacement pump may be a liquid pump or a lather pump as desired.

The line is typically a flexible plastic tubing which can be readily installed after the walls of the rooms are constructed.

The one-way valve in the line adjacent the supply container also prevents soap dripping from the line or leaking out during changing of the soap container.

In the embodiment shown in FIGS. 6–9, components corresponding to those of the earlier figures are identified by the same reference numbers. In this embodiment, the dispensers 15 are mounted on the counter 13, and a cabinet 55 is mounted underneath the counter for receiving the liquid cleanser container 16 and the support box 17. Preferably, the cabinet has a hinged door 56 with a locking latch 57 for controlling access to the cabinet. While any dispenser may be utilized, the presently preferred dispenser design is that shown in U.S. Pat. No. 5,476,197.

Figure 7:
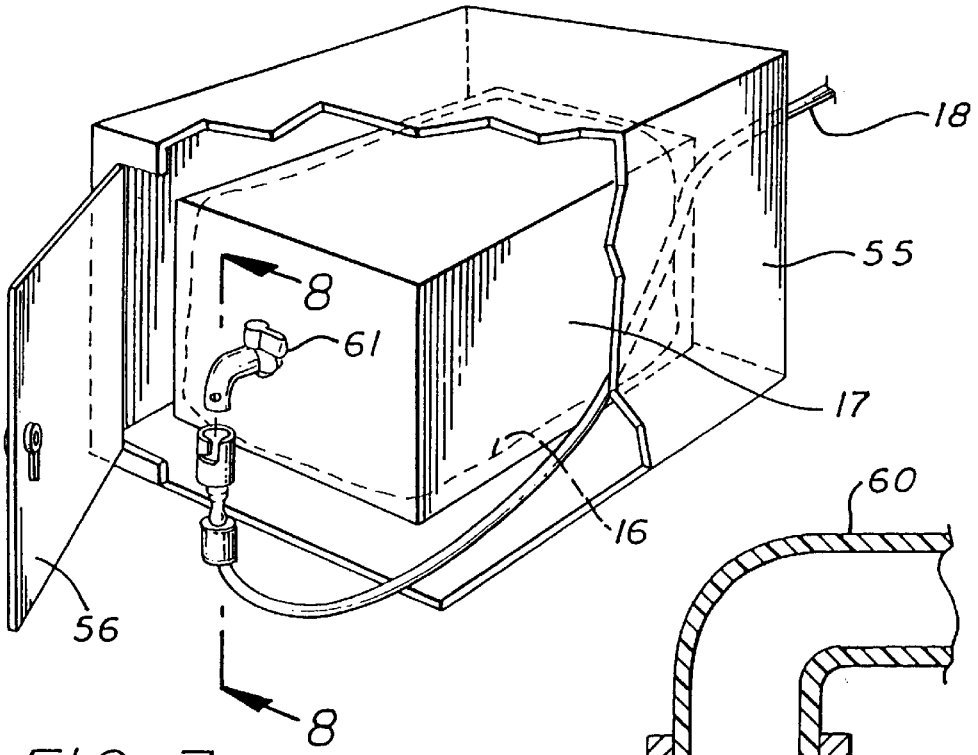
FIG. 7 is an enlarged view of a portion of FIG. 6 showing the installation of the cleanser container and support box in the cabinet.
Figure 8:
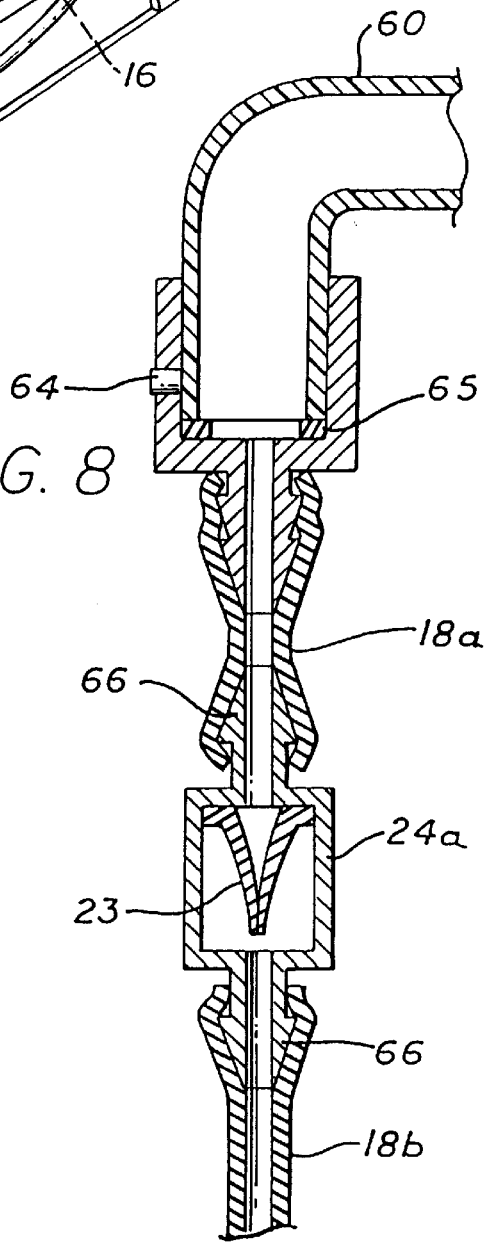
FIG. 8 is an enlarged partial sectional view taken along the line 8—8 of FIG. 7.
Figure 9:
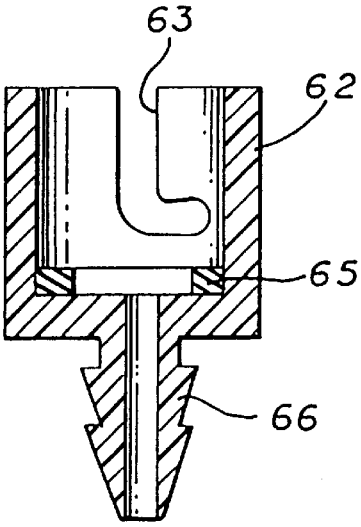
FIG. 9 is an enlarged sectional view of the connector of FIGS. 7 and 8.

In this embodiment as illustrated in FIGS. 7–9, an outlet nozzle 60 is carried in the support box 17 for connection to the container 16. A lever control valve 61 may be affixed in the nozzle for controlling flow.

The flexible line 18 is connected to the nozzle 60 by a coupling 62 with a J-shaped slot 63 for engaging a pin 64 at the outer end of the nozzle 60. Typically a gasket 65 is positioned in the coupling 62 for sealing engagement with the end of the nozzle 60.

A one-way valve 23 may be positioned in the line 18 in a fitting 24*a,* with this fitting connected between portions 18*a* and 18*b* of the line by conventional barbed projections 66.

The construction of the invention readily permits the use of the large capacity containers now available, including the twelve and twenty-four liter containers now used for soap supplies. In operation, the flexible container collapses as the soap is withdrawn, since the container is airtight. When the container is empty, the pumps will stop delivering soap but the supply lines will remain full of liquid as they do not collapse and no air is displacing the liquid content. Therefore, the dispensing system will remain pre-primed.

The container exchange is a time saving feature for maintenance; no bulk soap is poured or spilled . This system is very hygienic with no outside contamination problem. The system is essentially vandal proof having no vessels to tamper with. This system is a low-cost installation and maintenance system; expensive stainless steel vessels are not needed. The washing system is especially suitable for use in fast food restaurants and other installations with high public traffic where frequent interruptions for servicing the equipment is undesirable.

Advantages of the new washing system include the following. It delivers soap thru soap pumps which can be mounted directly to the wall or counter, without costly soap vessels attached to them. It handles a wide range of soap viscosity from water thin to shampoo like thickness. The system has a centrally located soap reservoir for supply to all the soap pumps. A single fill of the reservoir will refill the complete washroom. The soap reservoir can be mounted on the floor level or under counter or in a remote area. The soap pumps may be connected to the reservoir via plastic tubing running behind the wall, above a hung ceiling, to a maintenance or service room, normally 25 to 50 feet away, to the soap reservoir. This soap reservoir will usually be in the same room containing the cleaning supply. The soap pumps will stop delivering once the soap reservoir is empty, but the supply plastic tubes will remain filled with liquid at all times for quick priming. The long supply line will have a one-way valve on its end by the soap reservoir. This valve will prevent the tube from draining during soap refilling. The soap reservoir is a sealed large plastic collapsible container. The first time priming of the system will be done by providing the long supply line pre-filled soap in the factory, and plugged at both ends. No re-priming is required in between refills.

I claim:

1. A washing system, comprising:

a plurality of dispensers, each dispenser having a positive displacement pump, an inlet to the positive displacement pump and an outlet from the positive displacement pump;

a collapsible container containing a liquid cleanser, the collapsible container having a first outlet;

container support means for supporting the collapsible container of liquid cleanser;

a flexible supply line for connecting the collapsible container to the inlet to each of said pumps, the flexible supply line having a first end connected to the first outlet of the collapsible container and a plurality of additional ends connected to the inlets to the pumps to permit the flow of liquid cleanser from the first outlet of the collapsible container to each of the pumps; and a first one-way valve in said line for blocking fluid flow to the collapsible container while permitting fluid flow from the collapsible container to the dispensers.

2. A washing system as defined in claim 1 wherein said flexible supply line includes an airtight cap mating with the first outlet on the collapsible container, with said first one-way valve positioned in said flexible supply line at said cap.

3. A washing system as defined in claim 1 including a cabinet with said container support means positioned in said cabinet, said cabinet having an access door for replacing a used collapsible container with a new collapsible container and locking means for securing said access door on said cabinet.

4. A washing system as defined in claim 1 wherein said flexible supply line comprises at least three lengths of plastic tubing and at least one tee fitting providing flow paths from the collapsible container to each of said dispensers with said first one-way valve in said line between said tee fitting and the collapsible container.

5. A washing system as defined in claim 1 wherein said dispensers are mounted on a wall in a first room, said container support means is positioned in a second room, and said supply line is behind said wall between said dispensers and said cabinet support means in said second room.

6. A washing system as defined in claim 1 wherein said dispensers are mounted on a counter and said supply line is under said counter.

7. A washing system as defined in claim 1 wherein said dispensers are mounted on a counter, said container support means is below said counter, and said supply line is under said counter.

8. A washing system as defined in claim 1 wherein said dispensers are mounted on a wall and said supply line is behind said wall.

9. A washing system as defined in claim 1 wherein said dispensers are mounted on a wall above a counter, said container support means is below said counter, and said supply line is behind said wall between said dispensers and said container support means.

10. In a washing system for dispensing a liquid cleanser from a collapsible container, the combination of:

a dispenser having positive displacement pump, mounting means for mounting said pump on a dispenser support, and connection means for connecting said pump to a flexible supply line;

container support means for supporting a collapsible container of liquid cleanser; and a flexible supply line for connecting the collapsible container to each of said pumps, with a first one-way valve in said line for blocking fluid flow to the collapsible container while permitting fluid flow from the collapsible container to said dispensers;

wherein the dispenser includes a tubular casing with an inlet tube as said connection means for slidingly receiving an end of said flexible supply line and with said positive displacement pump slidably inserted into said casino, said positive displacement pump having a cylinder with a piston cavity and a piston sliding in said cavity, means defining an inlet opening in said cylinder for fluid flow from said flexible supply line through said inlet tube into said piston cavity, a spring in said piston cavity for urging said piston outward, a second one-way valve positioned between said inlet opening of said cylinder and said spring, and a third one-way valve positioned between said spring and said piston, with said piston having an outlet flow passage defining a flow path from said flexible supply line through said casing inlet tube, said cylinder and said piston cavity to the exterior of said dispenser.

11. A washing system as defined in claim 10 wherein the pump further includes first retainer means for fixing said cylinder in said casing, first sliding seal means between said cylinder and said casing for blocking fluid flow from said casing around said cylinder, second sliding seal means between said piston and the interior of said cylinder for blocking fluid flow from said cylinder around said piston, and second retainer means for retaining said piston in said cylinder while permitting reciprocation of said piston in said cylinder during fluid dispensing.

12. A washing system as defined in claim 10 wherein the pump further includes means defining at least two mounting openings in the wall of said casing with the axis of said mounting opening parallel with each other, with internal shoulders in said openings for receiving dispenser mounting screws with heads concealed in said openings.

13. In a washing system for dispensing a liquid cleanser from a collapsible container, the combination of:

a plurality of dispensers, each dispenser having a positive displacement pump, mounting means for mounting said pump on a dispenser support, and connection means for connecting said pump to a flexible supply line;

container support means for supporting a collapsible container of liquid cleanser; and a flexible supply line for connecting the collapsible container to each of said pumps, with a first one-way valve in said line for blocking fluid flow to the collapsible container while permitting fluid flow from the collapsible container to said dispensers;

with each of said dispensers including a tubular casing with an inlet tube as said connection means for slidingly receiving an end of said flexible supply line and with said positive displacement pump slidably inserted into said casing, said positive displacement pump having a cylinder with a piston cavity and a piston sliding in said cavity, means defining an inlet opening in said cylinder for fluid flow from said flexible supply line through said inlet tube into said piston cavity, a spring in said piston cavity for urging said piston outward, a second one-way valve positioned between said inlet opening of said cylinder and said spring, and a third one-way valve positioned between said spring and said piston, with said piston having an outlet flow passage defining a flow path from said flexible supply line through said casing inlet tube, said cylinder and said piston cavity to the exterior of said dispenser, first retainer means for fixing said cylinder in said casing, first sliding seal means between said cylinder and said casing for blocking fluid flow from said casing around said cylinder, second sliding seal means between said piston and the interior of said cylinder for blocking fluid flow from said cylinder around said piston, and second retainer means for retaining said piston in said cylinder while permitting reciprocation of said piston in said cylinder during fluid dispensing.

14. A dispenser for a washing system for dispensing a liquid cleanser from a collapsible container, said dispenser having a positive displacement pump, mounting means for mounting said pump on a dispenser support, and connection means for connecting said pump to a flexible supply line, said dispenser further having a tubular casing with an inlet tube as said connection means for slidingly receiving an end of a flexible supply line and with said positive displacement pump slidably inserted into said casing, said positive displacement pump having a cylinder with a piston cavity and a piston sliding in said cavity, means defining an inlet opening in said cylinder for fluid flow through said inlet tube into said piston cavity, a spring in said piston cavity for urging said piston outward, a first one-way valve positioned between said inlet opening of said cylinder and said spring, a second one-way valve positioned between said spring and said piston, with said piston having an outlet flow passage defining a flow path through said casing inlet tube, said cylinder and said piston cavity to the exterior of said dispenser.

15. dispenser as defined in claim 14 including first retainer means for fixing said cylinder in said casing, first sliding seal means between said cylinder and said casing for blocking fluid flow from said casing around said cylinder, second sliding seal means between said piston and the interior of said cylinder for blocking fluid flow from said cylinder around said piston, and second retainer means for retaining said piston in said cylinder while permitting reciprocation of said piston in said cylinder during fluid dispensing.

16. A dispenser as defined in claim 14 including means defining at least two mounting openings in the wall of said casing with the axis of said mounting openings parallel with each other, with internal shoulders in said openings for receiving wall mounting screws with heads concealed in said openings.

17. A washing system comprising:

a dispenser having a positive displacement pump, an inlet to the positive displacement pump and an outlet from the positive displacement pump;

a collapsible container containing a liquid cleanser, the collapsible container having an outlet;

container support means for supporting the collapsible container of liquid cleanser; and a flexible supply line for connecting the collapsible container to the pump, the flexible supply line having a first end connected to the outlet of the collapsible container and a second end connected to the inlet to the pump; and a first one-way valve in said line for blocking fluid flow to the collapsible container while permitting fluid flow from the collapsible container to the dispenser.

18. The washing system of claim 17 wherein the first outlet protrudes out a side wall of the container support means.

19. The washing system of claim 17 wherein the positive displacement pump has a piston that is manually powered.

20. The washing system of claim 19 wherein the dispenser outlet and the manually powered piston are sufficiently close to each other to permit a user to actuate the piston to dispense liquid cleanser from the dispenser outlet into the user's hand.

* * * * *

UNITED STATES PATENT AND TRADEMARK OFFICE

CERTIFICATE OF CORRECTION

PATENT NO. : 5,988,451

DATED : November 23,1999

INVENTOR(S) : Hanna, Emmanuel A.

It is certified that error appears in the above-identified patent and that said Letters Patent is hereby corrected as shown below:

In claim 10, at column 7, line 38, delete "casino" and insert --casing--.

Signed and Sealed this

Twenty-third Day of May, 2000

*Attest:*

Q. TODD DICKINSON

*Attesting Officer*

*Director of Patents and Trademarks*